US012679428B2

(12) United States Patent
Zäch

(10) Patent No.: US 12,679,428 B2
(45) Date of Patent: Jul. 14, 2026

(54) ASSEMBLY FOR TRANSMITTING LONGITUDINAL FORCES IN A RAIL VEHICLE

(71) Applicant: Siemens Mobility GmbH, Munich (DE)

(72) Inventor: Martin Zäch, Raubling (DE)

(73) Assignee: Siemens Mobility GmbH, Munich (DE)

( * ) Notice: Subject to any disclaimer, the term of this patent is extended or adjusted under 35 U.S.C. 154(b) by 553 days.

(21) Appl. No.: 18/257,994

(22) PCT Filed: Nov. 17, 2021

(86) PCT No.: PCT/EP2021/081992
§ 371 (c)(1),
(2) Date: Jun. 16, 2023

(87) PCT Pub. No.: WO2022/128301
PCT Pub. Date: Jun. 23, 2022

(65) Prior Publication Data

US 2024/0001973 A1 Jan. 4, 2024

(30) Foreign Application Priority Data

Dec. 16, 2020 (DE) ..... 10 2020 216 069.4

(51) Int. Cl.
*B61F 5/38* (2006.01)
*B61F 5/30* (2006.01)

(52) U.S. Cl.
CPC ..... *B61F 5/386* (2013.01); *B61F 5/308* (2013.01)

(58) Field of Classification Search
CPC .... B61F 5/00; B61F 5/38; B61F 5/308; B61F 5/386
See application file for complete search history.

(56) References Cited

U.S. PATENT DOCUMENTS 4,640,198 A * 2/1987 Haupl ..... B61F 5/386 105/168
10,300,932 B2 * 5/2019 Meyer ..... B61F 3/08
(Continued)

FOREIGN PATENT DOCUMENTS

CN 103339013 A 10/2013
CN 106828528 A 6/2017
(Continued)

*Primary Examiner* — Robert J McCarry, Jr.
(74) *Attorney, Agent, or Firm* — Laurence A. Greenberg; Werner H. Stemer; Ralph E. Locher

(57) ABSTRACT

An assembly transmits longitudinal forces in a rail vehicle. The assembly contains a first and second hydraulic axle link bearing, a wheel set, and a rotary frame. Each axle link bearing has a housing element and a first and second chamber filled with a fluid. In the event of a change in the position of the housing elements relative to each other, fluid is exchanged between connected chambers of the axle link bearings. The fluid exchange is produced by a change in the position of the housing elements relative to each other, and the change in position causes the transmission of longitudinal forces which are transmitted between the wheel set and the rotary frame via the axle link bearings. A first chamber of the first axle link bearing is connected to a first chamber of the second axle link bearing via a damping element in order to exchange fluid.

5 Claims, 4 Drawing Sheets

(56) References Cited

U.S. PATENT DOCUMENTS

| | | | |
|---|---|---|---|
| 10,906,566 | B2 | 2/2021 | Dede et al. |
| 2013/0312634 | A1 | 11/2013 | Smit |

FOREIGN PATENT DOCUMENTS

| | | | |
|---|---|---|---|
| CN | 108290584 | A | 7/2018 |
| CN | 111232008 | A | 6/2020 |
| DE | 3123858 | A1 | 12/1982 |
| DE | 69920527 | T2 | 9/2005 |
| DE | 102010033811 | A1 | 2/2012 |
| DE | 102013103827 | A1 | 10/2014 |
| EP | 0655378 | A1 | 5/1995 |
| EP | 1228937 | A1 | 8/2002 |
| EP | 1457706 | A1 | 9/2004 |
| EP | 2762377 | A1 | 8/2014 |
| EP | 3117120 | B1 | 5/2020 |
| FR | 2551412 | A1 | 3/1985 |
| JP | S63231032 | A | 9/1988 |
| WO | 2016008731 | A1 | 1/2016 |

* cited by examiner

ASSEMBLY FOR TRANSMITTING LONGITUDINAL FORCES IN A RAIL VEHICLE

FIELD AND BACKGROUND OF THE INVENTION

The invention relates to an assembly for transmitting longitudinal forces in a rail vehicle.

The document EP 1 457 706 A1 has disclosed a hydraulic axle link bearing by means of which the driving behavior of rail vehicles is optimized both during cornering and during straight-ahead travel. The basic prerequisite for this optimization is a wheelset whose orientation in relation to the rail or in relation to a curve being traveled along is settable.

The hydraulic axle link bearing for a rail vehicle described in the document EP 1 457 706 A1 comprises a link bolt and at least one spring element which is arranged between the link bolt and a link eye of an axle link. The spring element comprises a hydraulic bushing which has an outer housing and an inner housing. The outer housing encloses the inner housing at a radial spacing, such that an annular gap is formed. A (rubber-)elastic element is arranged in the annular gap in such a way that it at least partially delimits two diametrically oppositely located chambers, which are referred to as first chamber and second chamber, respectively. The two chambers are filled with a hydraulic fluid. The two chambers are connected to one another by way of an internally guided overflow duct.

By way of the overflow duct, a displacement of fluid between the two chambers is achieved, such that a required low degree of longitudinal stiffness is achieved during cornering and a required high degree of stiffness is achieved during curve-free or straight-line travel. This setting also achieves low-wear and low-noise travel in a curve progression of the rail. This optimized orientation of the wheelset is made possible by way of the hydraulic axle link bearing, which has to have the lowest possible degree of longitudinal stiffness during cornering and a very high degree of stiffness during curve-free or straight-line travel.

"Hydraulic axle link bearings with external connection (HLeA)", in which, compared with the preceding axle link bearing, the overflow duct is implemented externally, are also known. For this purpose, the first chamber and the second chamber each have a connection which is guided toward the outside in the case of the "hydraulic axle link bearing with external connection (HLeA)". This makes it possible to connect the two chambers externally by way of a connecting line or to allow the two chambers to be coupled to other components, as described below.

FIG. 5 shows two wheelsets RS1, RS2 of a rail vehicle which are connected in a known manner to a truck DGST of a rail vehicle by way of hydraulic axle link bearings ALL1 to ALL4.

For a first wheelset RS1 of the rail vehicle, the following applies:

The first wheelset RS1 is connected to the truck DGST by way of two hydraulic axle link bearings ALL1 and ALL2, which have external connections and are configured as described above.

A first axle link bearing ALL1 has two (diametrically) oppositely located chambers KAM11, KAM12, which are referred to as first chamber KAM11 and as second chamber KAM12, respectively.

As seen in a direction of travel FRTR of the rail vehicle, the second chamber KAM12 is arranged upstream of the first chamber KAM11.

A second axle link bearing ALL2 has two (diametrically) oppositely located chambers KAM21, KAM22, which are referred to as first chamber KAM21 and as second chamber KAM22, respectively.

As seen in the direction of travel FRTR of the rail vehicle, the second chamber KAM22 is arranged upstream of the first chamber KAM21.

In the case of the first wheelset RS1, the first chamber KAM11 of the first axle link bearing ALL1 is connected to the first chamber KAM21 of the second axle link bearing ALL2 by way of external connections for the exchange of fluid.

In the case of the first wheelset RS1, the second chamber KAM12 of the first axle link bearing ALL1 is connected to the second chamber KAM22 of the second axle link bearing ALL2 by way of external connections for the exchange of fluid.

If, as seen in the direction of travel FRTR, the rail vehicle performs right-handed cornering RKV, the fluid is then transferred from the second chamber KAM22 of the second axle link bearing ALL2 into the second chamber KAM12 of the first axle link bearing ALL1 due to the influence of resulting longitudinal forces.

This transfer of fluid is caused by a change in the relative position of the housing elements of the axle link bearings ALL1, ALL2, which is in turn caused by the longitudinal forces.

In the correspondingly inverse case, fluid is transferred from the first chamber KAM11 of the first axle link bearing ALL1 into the first chamber KAM21 of the second axle link bearing ALL2.

For a second wheelset RS2 of the rail vehicle, the following applies:

The second wheelset RS2 is connected to the truck DGST by way of two hydraulic axle link bearings ALL3 and ALL4, which have external connections and are configured as described above.

A first axle link bearing ALL3 has two diametrically oppositely located chambers KAM31, KAM32, which are referred to as first chamber KAM31 and as second chamber KAM32, respectively.

As seen in the direction of travel FRTR of the rail vehicle, the first chamber KAM31 is arranged upstream of the second chamber KAM32.

A second axle link bearing ALL4 has two diametrically oppositely located chambers KAM41, KAM42, which are referred to as first chamber KAM41 and as second chamber KAM42, respectively.

As seen in the direction of travel FRTR of the rail vehicle, the first chamber KAM41 is arranged upstream of the second chamber KAM21.

In the case of the second wheelset RS2, the first chamber KAM31 of the first axle link bearing ALL3 is connected to the first chamber KAM41 of the second axle link bearing ALL4 by way of external connections for the exchange of fluid.

In the case of the second wheelset RS2, the second chamber KAM32 of the first axle link bearing ALL3 is connected to the second chamber KAM42 of the second axle link bearing ALL4 by way of external connections for the exchange of fluid.

If, as seen in the direction of travel FRTR, the rail vehicle performs right-handed cornering RKV, fluid is then transferred from the first chamber KAM41 of the second axle link bearing ALL4 into the first chamber KAM31 of the first axle link bearing ALL3.

In the correspondingly inverse case, fluid is transferred from the second chamber KAM32 of the first axle link bearing ALL3 into the second chamber KAM42 of the second axle link bearing ALL4.

Due to the described arrangement and connection of the chambers, the movement of the right-hand and of the left-hand wheelset side is coupled and an advantageous movement behavior of the wheelset is produced by way of a corresponding transmission of longitudinal force.

Respective longitudinal forces, which occur during straight-ahead travel or during cornering, are transmitted between the above-described components as illustrated.

SUMMARY OF THE INVENTION

It is the object of the present invention to specify an improved assembly for transmitting longitudinal forces in a rail vehicle.

This object is achieved by the features of the independent claim. Advantageous refinements are specified in the dependent claims.

The invention relates to an assembly for transmitting longitudinal forces in a rail vehicle, having a first and having a second hydraulic axle link bearing, having a wheelset and having a truck of the rail vehicle.

Each axle link bearing has an outer housing element and an inner housing element, and also a first and a second chamber filled with a fluid. The two chambers are arranged opposite to one another between the two housing elements, such that in the event of a change in the position of the inner housing element relative to the outer housing element, an alternately occurring change in the volume of the two chambers is caused via an exchange of fluid.

Each axle link bearing has two external connections, wherein each chamber of the axle link bearing is connected to a respective external connection.

Each axle link bearing is connected both to the truck and to the wheelset by way of the associated housing elements, in order to transmit longitudinal forces formed by the rail vehicle during travel between the wheelset and the truck. In the case of each axle link bearing, the longitudinal forces cause the change in the position of the inner housing element relative to the outer housing element and thus the alternating change in volume in the two chambers due to the exchange of fluid.

According to the invention, a first chamber of the first axle link bearing is connected to a first chamber of the second axle link bearing by way of a damping element for the exchange of fluid. A second chamber of the first axle link bearing is connected to a second chamber of the second axle link bearing directly for the exchange of fluid.

Advantageously, a degree of stiffness is also introduced into the system, or influenced, by way of the damping element.

In an advantageous refinement, as seen in the direction of travel of the rail vehicle and with respect to a horizontal plane which is oriented in the direction of travel, the respective second chambers are arranged upstream of the respective first chambers in the case of the first axle link bearing and in the case of the second axle link bearing.

In an advantageous refinement, in the case of the axle link bearing, the outer housing element encloses the inner housing element at a radial spacing, such that an annular gap is formed. A (rubber-)elastic element is arranged in the annular gap in such a way that it forms the two mutually opposite chambers.

In an advantageous refinement, in the case of the axle link bearing, the first chamber is connected to a first connection by way of a first duct which runs inside the inner housing element. This first connection is arranged as part of the inner housing element in the outer region of the axle link bearing. The second chamber is connected to a second connection by way of a second duct which runs inside the inner housing element. This second connection is arranged as part of the inner housing element in the outer region of the axle link bearing.

In an advantageous refinement, the damping element is in the form of a cylinder which is filled with the fluid and which has an integrated ram. The ram is arranged in such a way that the fluid of the two first chambers which acts on the ram during the exchange of fluid causes a damped movement of the ram in the cylinder.

In an advantageous refinement, the cylinder has a cylinder total volume which is divided into a first cylinder partial volume and into a second cylinder partial volume by way of the movably mounted ram, such that, depending on the movement direction of the ram during the exchange of fluid, an alternating change in volume in the first cylinder partial volume and in the second cylinder partial volume is effected by the ram.

In this case, the first cylinder partial volume is connected to the first chamber of the first axle link bearing by way of an external connection of said first axle link bearing, while the second cylinder partial volume is connected to the first chamber of the second axle link bearing by way of an external connection of said second axle link bearing.

In an advantageous refinement, the ram is coupled to a spring and to a damper which is connected in parallel therewith, in order to damp the movement of the ram. An intended damping action, which is dependent on the position of the ram and/or on the movement direction thereof, is set by way of the spring and by way of the damper.

In an advantageous refinement, the damping element is embodied as a possibly adaptable line constriction, by which the movement of the fluid is damped.

Unstable eigenmodes of the rail vehicle are transformed into stable eigenmodes by way of the present invention.

Increased driving speeds are achieved with high safety by way of the present invention.

The driving stability of the rail vehicle is increased by way of the present invention.

By way of the present invention, the two lines make it possible for the damping element to be positioned at any desired point of the rail vehicle.

The present invention or the damping element connected by way of external lines makes it possible for this damping element to advantageously be arranged at a location with a sufficiently large installation space and thus possibly also remote from the axle link bearings.

In this way, a given packing density of components in the surroundings of the axle link bearings or of the truck is not additionally increased. Preferred locations for the damping element are conceivable, for example, in the entire region of the car body.

Overall, the individual degrees of stiffness of the axle link bearings and the individual damping actions of the axle link bearings, and also the damping action in the hydraulic system, result in a total degree of stiffness and a total damping action. Suitable or optimal parameter ranges for stiffness and damping are achieved by way of the present invention.

The present invention will be explained in more detail below by way of example on the basis of a drawing, in which:

DETAILED DESCRIPTION OF THE INVENTION

Figure 1:
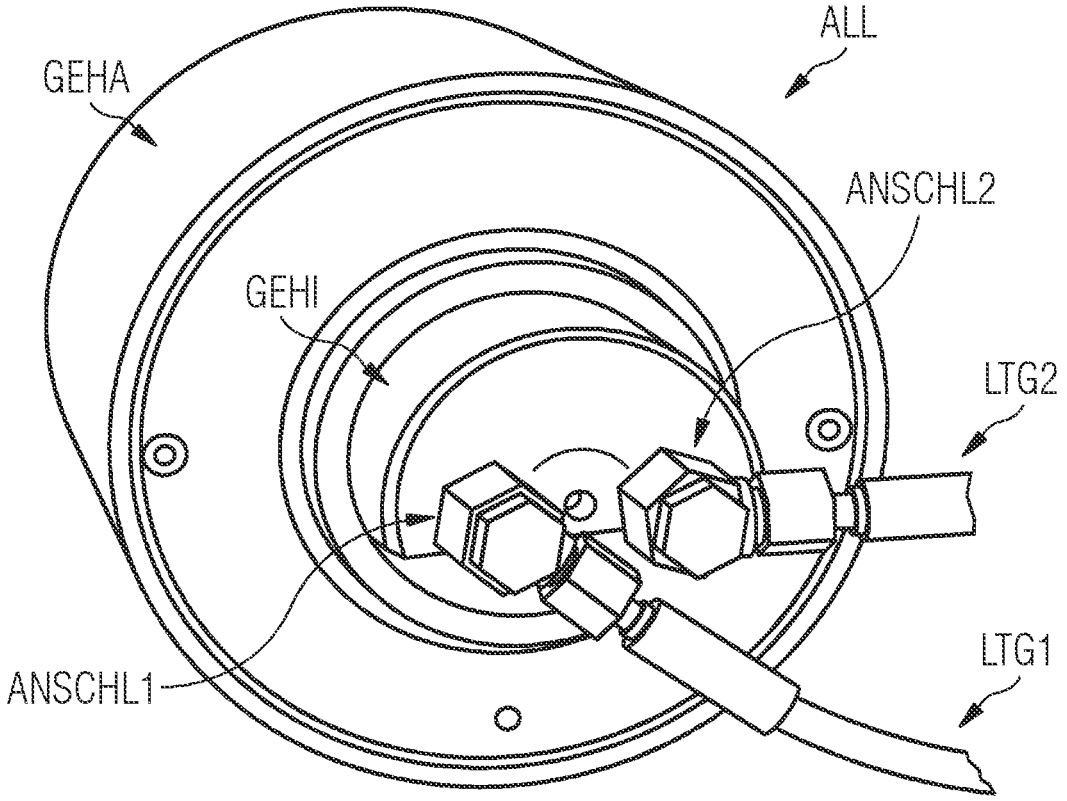
FIG. 1 shows a hydraulic axle link bearing with external connections, which forms an essential element of the present invention.
Figure 2:
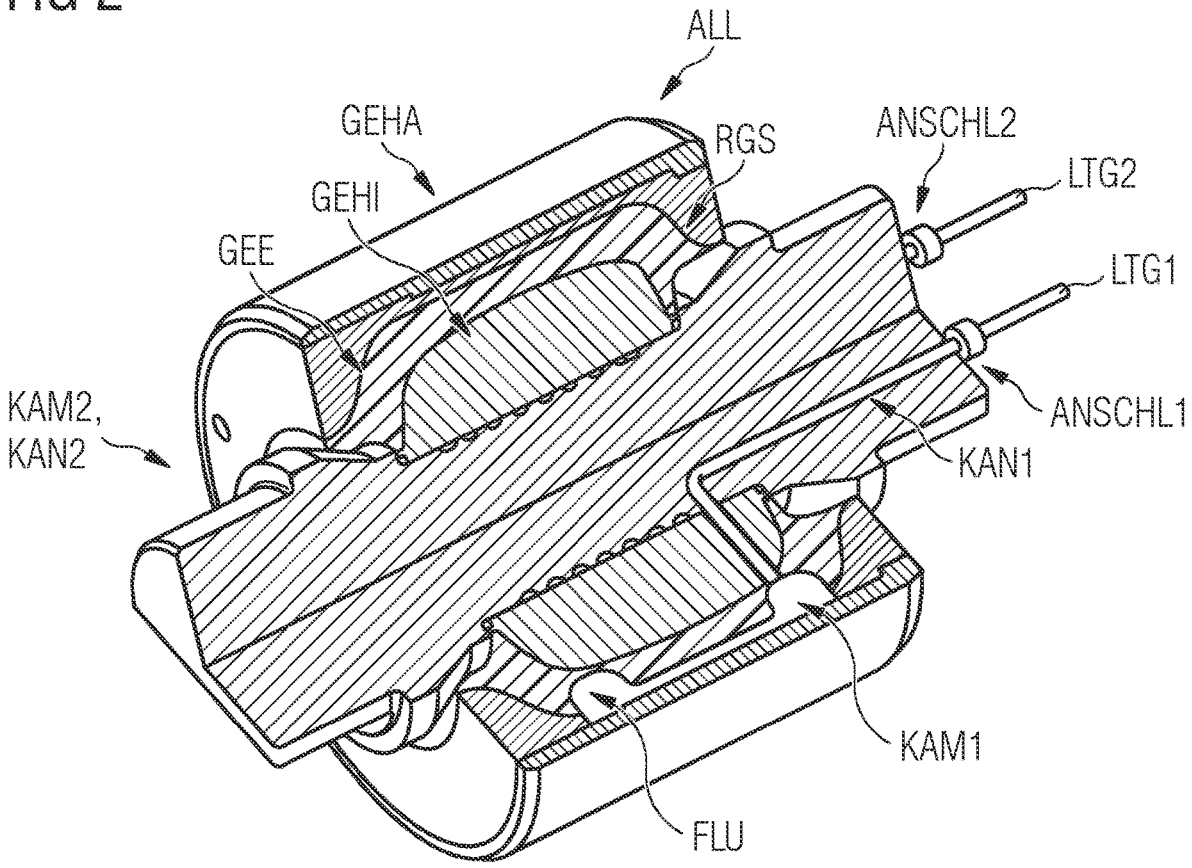
FIG. 2 shows a sectional illustration of the hydraulic axle link bearing shown in FIG. 1.

FIG. 1 shows a hydraulic axle link bearing ALL with external connections ANSCHL1, ANSCHL2, which forms an essential element of the present invention, while FIG. 2 shows a sectional illustration of the hydraulic axle link bearing ALL shown in FIG. 1.

The axle link bearing ALL has two external connections ANSCHL1, ANSCHL2 to which respective connecting lines LTG1, LTG2 are attached.

The hydraulic axle link bearing ALL has an outer housing element GEHA and an inner housing element GEHI.

The outer housing element GEHA encloses the inner housing element GEHI at a radial spacing, such that an annular gap RGS is formed.

A (rubber-)elastic element GEE is arranged in the annular gap RGS in such a way that it forms two mutually opposite chambers KAM1, KAM2 with respective chamber volume.

The two chambers KAM1, KAM2 contain a fluid FLU and are couplable to chambers of another axle link bearing by way of the two external connections ANSCHL1, ANSCHL2 and by way of the respective connecting lines LTG1, LTG2. This is described in more detail in FIG. 3.

The first chamber KAM1 is connected to the first connection ANSCHL1 by way of a first duct KAN1 which runs inside the inner housing element GEHI. Here, the first connection ANSCHL1 is part of the inner housing element GEHI and is arranged in the outer region of the axle link bearing ALL.

The same correspondingly applies to a second chamber KAM2, which is only indicated here. The second chamber KAM2 is connected to the second connection ANSCHL2 by way of a second duct KAN2 which also runs inside the inner housing element GEHI. The second connection ANSCHL2 is part of the inner housing element GEHI and is arranged in the outer region of the axle link bearing ALL.

In the event of a change in the position of the outer housing element GEHA relative to the inner housing element GEHI, a change in pressure is brought about in the two chambers KAM1, KAM2, such that the volumes in the two chambers KAM1, KAM2 change in an alternating manner.

If the volume in the first chamber KAM1 increases, then the volume in the second chamber decreases and vice versa.

The change in the relative position of the two housing elements GEHI, GEHA is caused by longitudinal forces which arise during the travel of the rail vehicle and which are transmitted from a wheelset to the outer housing element GEHA, from the latter to the inner housing element GEHI and from the latter to a truck of the rail vehicle.

Figure 3:
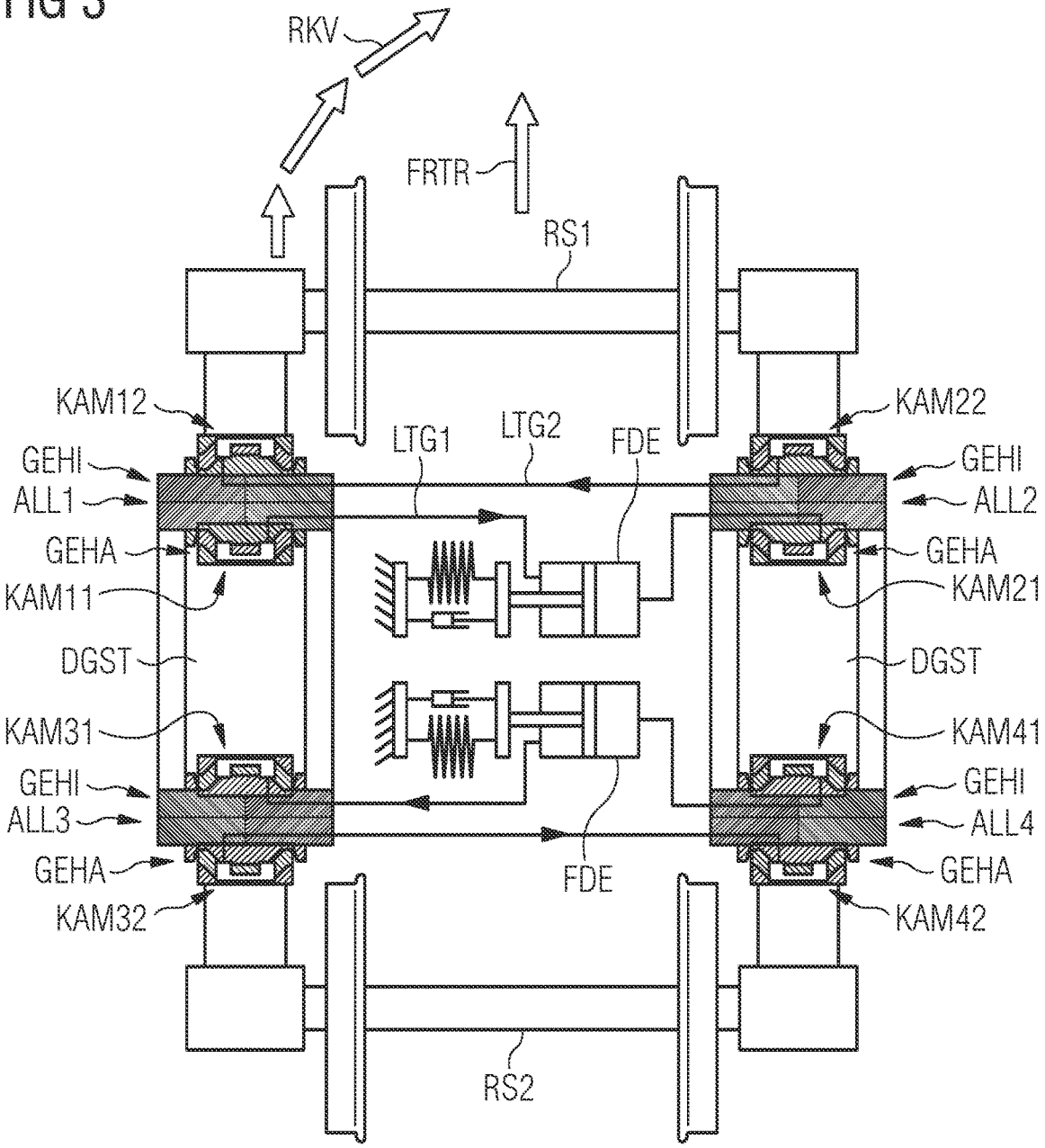
FIG. 3 shows, with respect to FIG. 1 and FIG. 2, the assembly according to the invention for transmitting longitudinal forces in a rail vehicle.

FIG. 3 shows, with respect to FIG. 1 and FIG. 2, the assembly according to the invention for transmitting longitudinal forces in a rail vehicle.

For a first wheelset RS1 of the rail vehicle, the following applies:

The first wheelset RS1 is connected to a truck DGST of the rail vehicle by way of two axle link bearings ALL1, ALL2.

By way of example, the wheelset RS1 here is connected to an outer housing element GEHA of a first axle link bearing ALL1 or of a second axle link bearing ALL2. Correspondingly, an inner housing element GEHI of the first axle link bearing ALL1 or of the second axle link bearing ALL2 is connected to the truck DGST.

The first axle link bearing ALL1 has two (diametrically) oppositely located chambers KAM11, KAM12, which are referred to as first chamber KAM11 and as second chamber KAM12, respectively.

The second axle link bearing ALL2 has two (diametrically) oppositely located chambers KAM21, KAM22, which are referred to as first chamber KAM21 and as second chamber KAM22, respectively.

The two hydraulic axle link bearings ALL1 and ALL2 each have two external connections, by means of which the respective chambers KAM11, KAM12, KAM21, KAM22 are connected for the exchange of fluid.

As seen in the direction of travel FRTR of the rail vehicle and with respect to a horizontal plane which is oriented in the direction of travel (FRTR), the respective second chambers KAM12, KAM22 are arranged upstream of the respective first chambers KAM11, KAM21 in the case of the first axle link bearing ALL1 and in the case of the second axle link bearing ALL2.

In the example shown here, the second chamber KAM12 of the first axle link bearing ALL1 is connected to the second chamber KAM22 of the second axle link bearing ALL2 directly.

According to the invention, the first chamber KAM11 of the first axle link bearing ALL1 is connected to the first chamber KAM21 of the second axle link bearing ALL2 by way of a damping element FDE.

If, as seen in the direction of travel FRTR, the rail vehicle performs right-handed cornering RKV, then a transmission of corresponding longitudinal forces between the wheelset RS1 and the truck DGST causes a change in the relative positions of the housing elements GEHI, GEHA of the two axle link bearings ALL1, ALL2.

This causes a transfer of fluid between the chambers:

The fluid of the second chamber KAM22 of the second axle link bearing ALL2 is transferred in the direction of the second chamber KAM12 of the first axle link bearing ALL1.

In the correspondingly inverse case, fluid is transferred from the first chamber KAM11 of the first axle link bearing ALL1 in the direction of the first chamber KAM21 of the second axle link bearing ALL2, but this transfer of fluid is effected in a damped manner on account of the damping element FDE.

For a second wheelset RS2 of the rail vehicle, the following applies:

The second wheelset RS2 is connected to a truck DGST of the rail vehicle by way of two axle link bearings ALL3, ALL4.

By way of example, the wheelset RS2 here is connected to an outer housing element GEHA of an axle link bearing referred to as third axle link bearing ALL3 or of an axle link bearing referred to as fourth axle link bearing ALL4. Correspondingly, an inner housing element GEHI of the third axle link bearing ALL3 or of the fourth axle link bearing ALL4 is connected to the truck DGST.

The third axle link bearing ALL3 has two (diametrically) oppositely located chambers KAM31, KAM32, which are referred to as first chamber KAM31 and as second chamber KAM32, respectively.

The fourth axle link bearing ALL4 has two (diametrically) oppositely located chambers KAM41, KAM42, which are referred to as first chamber KAM41 and as second chamber KAM42, respectively.

The two hydraulic axle link bearings ALL3 and ALL4 each have two external connections, by means of which the respective chambers KAM31, KAM32, KAM41, KAM42 are connected for the exchange of fluid.

As seen in the direction of travel FRTR of the rail vehicle and with respect to the horizontal plane which is oriented in the direction of travel (FRTR), the respective first chambers KAM31, KAM41 are arranged upstream of the respective second chambers KAM32, KAM42 in the case of the third axle link bearing ALL3 and in the case of the fourth axle link bearing ALL4.

In the example shown here, the second chamber KAM32 of the third axle link bearing ALL3 is connected to the second chamber KAM42 of the fourth axle link bearing ALL4 directly.

According to the invention, the first chamber KAM31 of the third axle link bearing ALL3 is connected to the first chamber KAM41 of the fourth axle link bearing ALL4 by way of a damping element FDE.

If, as seen in the direction of travel FRTR, the rail vehicle performs right-handed cornering RKV, then a transmission of corresponding longitudinal forces between the wheelset RS2 and the truck DGST causes a change in the relative positions of the housing elements GEHI, GEHA of the two axle link bearings ALL3, ALL4.

This causes a transfer of fluid between the chambers:

The fluid of the second chamber KAM32 of the third axle link bearing ALL3 is transferred in the direction of the second chamber KAM42 of the fourth axle link bearing ALL4.

In the correspondingly inverse case, fluid is transferred from the first chamber KAM41 of the fourth axle link bearing ALL4 in the direction of the first chamber KAM31 of the third axle link bearing ALL3, but this transfer of fluid is effected in a damped manner on account of the damping element FDE.

Figure 4:
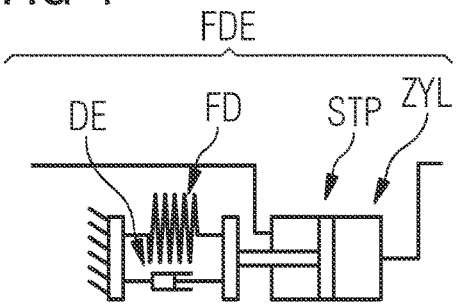
FIG. 4 shows details of the damping element shown in FIG. 3.
Figure 5:
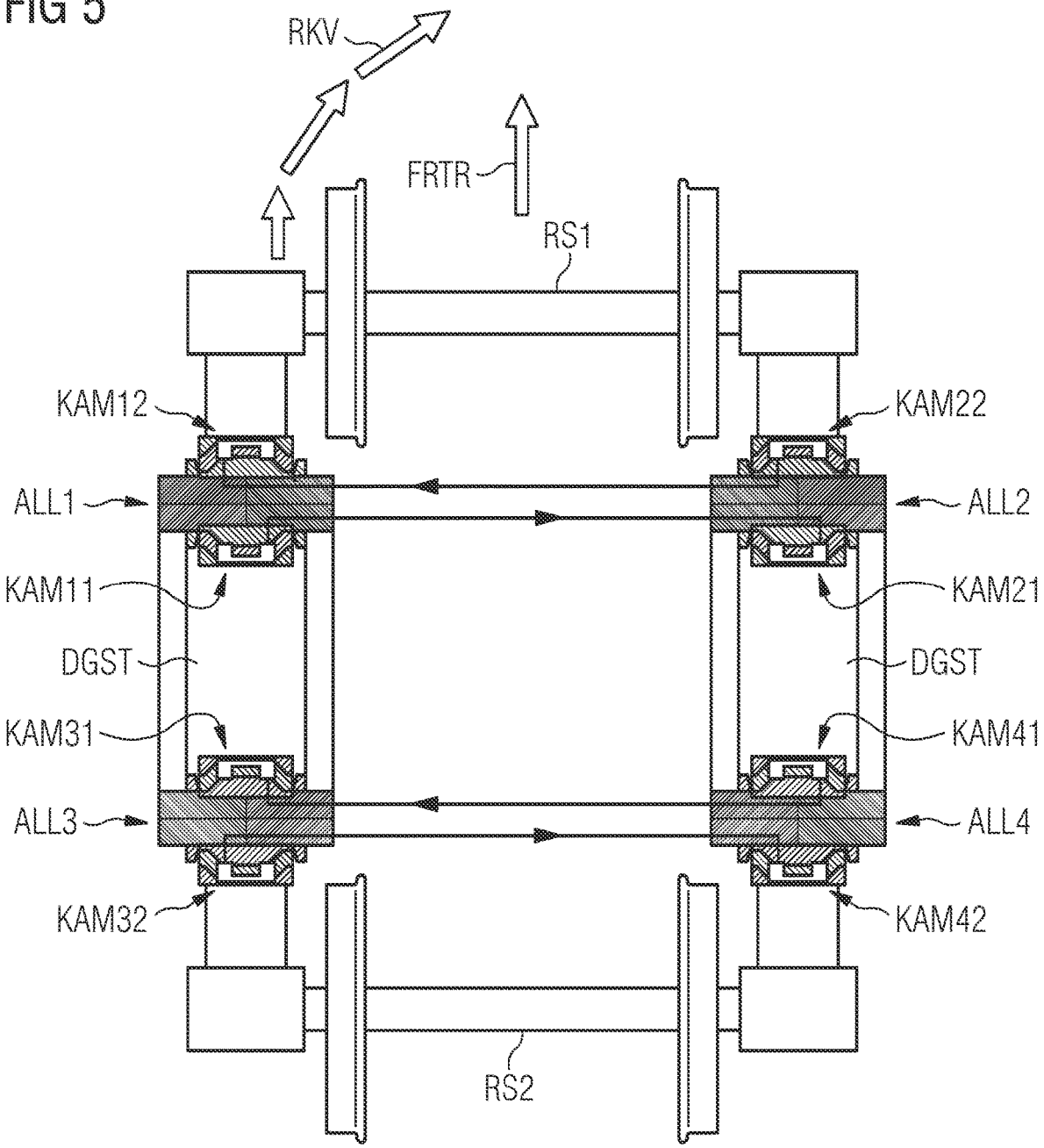
FIG. 5 shows the prior art described above in the introduction.

FIG. 4 shows details of the exemplary damping element FDE shown in FIG. 3.

Here, the damping element FDE is illustrated as a cylinder ZYL with an integrated ram STP, wherein the ram STP acts on a spring FD and on a damper DE which is connected in parallel with the spring FD.

The cylinder ZYL has a cylinder total volume which is filled with the fluid FLU and which is divided into a first cylinder partial volume and into a second cylinder partial volume by way of the movably mounted ram STP.

By way of the spring FD and the damper DE, an intended damping action is set in dependence on the position of the ram or in dependence on the movement direction of the ram STP.

Depending on the movement direction of the ram STP, a mutual partial volume change is effected. If the first cylinder partial volume is increased, then the second cylinder partial volume is decreased and vice versa.

The movement direction of the ram STP is determined by the movement direction of the fluid FLU.

Due to the movement of the ram STP, the action or coupling of the ram STP on or to the spring FD and on or to the damper DE is changed and thus the intended damping action is set.

The longitudinal degree of stiffness and/or the transverse degree of stiffness of the hydraulic axle link bearings ALL1 and ALL3, and thus the transmission of the longitudinal forces, is influenced by the damping element FDE.

The invention claimed is:

1. An assembly for transmitting longitudinal forces in a rail vehicle, the assembly comprising:

a wheelset;

a truck; and hydraulic axle link bearings including a first axle link bearing and a second axle link bearing, each of said hydraulic axle link bearings having an outer housing element, an inner housing element, a damping element, and two chambers including a first chamber and a second chamber filled with a fluid, said two chambers disposed opposite to one another between said inner housing element and said outer housing element, such that in an event of a change in a position of said inner housing element relative to said outer housing element, an alternately occurring change in a volume of said two chambers is caused via an exchange of the fluid, wherein each of said hydraulic axle link bearings further have two external connections and each of said two chambers of an axle link bearing of said hydraulic axle link bearings is connected to a respective one of said external connections, wherein each of said axle link bearings is connected both to said truck and to said wheelset by way of said inner and outer housing elements, in order to transmit the longitudinal forces formed by the rail vehicle during travel between said wheelset and said truck, wherein, in a case of each of said hydraulic axle link bearings, the longitudinal forces cause a change in a position of said inner housing element relative to said outer housing element and thus an alternating change in volume in said two chambers due to the exchange of the fluid, wherein said first chamber of said first axle link bearing is connected to said first chamber of said second axle link bearing by way of said damping element for the exchange of the fluid, and wherein said second chamber of said first axle link bearing is connected to said second chamber of said second axle link bearing directly for the exchange of the fluid, wherein said damping element is in a form of a cylinder which is filled with the fluid and which has an integrated ram, and wherein said integrated ram is disposed such that the fluid of said two first chambers which acts on said integrated ram during the exchange of the fluid causes a damped movement of said integrated ram in said cylinder;

said external connections including a first connection and a second connection;

said inner housing element having a first duct and a second duct, said first chamber is connected to said first connection by way of said first duct which runs inside said inner housing element;

said first connection being disposed as part of said inner housing element in an outer region of said axle link bearing;

said second chamber being connected to said second connection by way of said second duct which runs inside said inner housing element; and said second connection being disposed as part of said inner housing element in the outer region of said axle link bearing.

2. The assembly according to claim 1, wherein and as seen in a direction of travel of the rail vehicle and with respect to a horizontal plane which is oriented in the direction of travel, said second chambers are disposed upstream of said first chambers in a case of said first axle link bearing and in a case of said second axle link bearing.

3. The assembly according to claim 1, wherein in a case of said axle link bearing, said outer housing element encloses said inner housing element at a radial spacing, such that an annular gap is formed; and further comprising an elastic element disposed in said annular gap such that it forms said two mutually opposite chambers.

4. The assembly according to claim 1, wherein:

said cylinder has a cylinder total volume which is divided into a first cylinder partial volume and into a second cylinder partial volume by way of said integrated ram being a movably mounted ram, such that, depending on a movement direction of said integrated ram during the exchange of fluid, an alternating change in volume in said first cylinder partial volume and in said second cylinder partial volume is effected by said integrated ram; and said first cylinder partial volume is connected to said first chamber of said first axle link bearing by way of one of said external connections of said first axle link bearing; and said second cylinder partial volume is connected to said first chamber of said second axle link bearing by way of one of said external connections of said second axle link bearing.

5. The assembly according to claim 1, wherein:

said damping element has a spring and a damper, said integrated ram is coupled to said spring and to said damper which is connected in parallel with said spring, in order to damp a movement of said integrated ram; and an intended damping action, which is dependent on a position of said integrated ram and/or on a movement direction of said integrated ram, is set by way of said spring and by way of said damper.

* * * * *